US005997731A

United States Patent [19]

Suarez

[11] Patent Number: 5,997,731

[45] Date of Patent: Dec. 7, 1999

[54] PROCESS FOR TREATING AN EFFLUENT ALKALINE STREAM HAVING SULFUR-CONTAINING AND PHENOLIC COMPOUNDS

[75] Inventor: Felipe J. Suarez, Houston, Tex.

[73] Assignee: Merichem Company, Houston, Tex.

[21] Appl. No.: 09/049,169

[22] Filed: Mar. 27, 1998

[51] Int. Cl.[6] ..... C10G 19/00; C10G 19/08

[52] U.S. Cl. ..... 208/230; 208/203; 208/226; 208/235; 423/183; 210/757

[58] Field of Search ..... 208/203, 206, 208/230, 226, 235; 423/182, 183; 210/724, 757

[56] References Cited

U.S. PATENT DOCUMENTS

| | | | |
|---|---|---|---|
| 2,215,359 | 9/1940 | Livingston et al. | 208/324 |
| 3,585,005 | 6/1971 | Coggan | 422/257 |
| 3,758,404 | 9/1973 | Clonts | 208/263 |
| 3,839,487 | 10/1974 | Clonts | 585/724 |
| 3,923,645 | 12/1975 | Anderson et al. | 208/206 |
| 3,977,829 | 8/1976 | Clonts | 422/256 |
| 3,989,466 | 11/1976 | Pan | 422/257 |
| 3,992,156 | 11/1976 | Clonts | 422/256 |
| 4,019,869 | 4/1977 | Morris | 422/256 |
| 4,039,389 | 8/1977 | Christman | 196/14.52 |
| 4,206,079 | 6/1980 | Frame | 252/428 |
| 4,213,877 | 7/1980 | Frame | 252/412 |
| 4,219,420 | 8/1980 | Muller | 210/82 |
| 4,364,821 | 12/1982 | O'Brien | 208/325 |
| 4,481,107 | 11/1984 | Urban | 208/206 |
| 4,491,565 | 1/1985 | Verachtert | 422/256 |
| 4,666,689 | 5/1987 | Maple et al. | 423/183 |
| 4,675,100 | 6/1987 | Maple et al. | 208/203 |
| 4,746,494 | 5/1988 | Maple et al. | 422/189 |
| 4,753,722 | 6/1988 | Le et al. | 208/207 |
| 5,434,329 | 7/1995 | Lehr | 585/803 |

*Primary Examiner*—Walter D. Griffin
*Assistant Examiner*—Tam M. Nguyen
*Attorney, Agent, or Firm*—Jenkens & Gilchrist PC

[57] ABSTRACT

An alkaline solution containing dissolved sodium sulfides, mercaptides and phenolates is treated with a carbon dioxide-containing solvent in a reaction zone under mass transfer conditions to neutralize effluent alkaline solution and recover processable hydrocarbon values.

17 Claims, 2 Drawing Sheets

PROCESS FOR TREATING AN EFFLUENT ALKALINE STREAM HAVING SULFUR-CONTAINING AND PHENOLIC COMPOUNDS

FIELD OF THE INVENTION

This invention relates to the treatment of alkaline solutions, such as aqueous solutions of an alkali metal hydroxide, containing sulfides, mercaptides and phenolates. More particularly, it relates to a method and apparatus for treating such alkaline solutions by utilizing carbon dioxide to chemically reduce the sulfides, mercaptides and the phenolates contained therein and to regulate the pH of the alkaline solution.

BACKGROUND OF THE INVENTION

Commonly, hydrocarbon streams produced by refining operations or natural gas liquids processing operations contain phenolics and sulfur compounds, such as hydrogen sulfide and mercaptans. These streams are usually treated with alkaline solutions such as aqueous solutions of an alkali metal hydroxide in order to remove such sulfur compounds and phenolics and reduce odor and corrosivity associated with these acidic species. For example, mercaptans are generally removed from such hydrocarbon streams by washing or contacting such streams with an aqueous solution of sodium hydroxide or potassium hydroxide. The sulfur compounds are absorbed into the alkaline solution and reacted with it to form sulfides and mercaptides, i.e., the metal salts of hydrogen sulfide and the mercaptans respectively. Also any phenolics contained in thermal or catalytic cracked hydrocarbons are typically converted to phenolates when absorbed into the alkaline solution. The alkaline solution containing the sulfides, mercaptides, and phenolates is then typically separated from the hydrocarbon stream, regenerated and recycled for contacting more of the sulfur-containing hydrocarbon stream, until its alkalinity is reduced below effective levels. Effluent alkaline solutions that contain toxic contaminants such as hydrogen sulfide, or have a pH value greater than 12.5 are defined by the U.S. Environmental Protection Office as characteristic hazardous waste. Consequently, they require special handling prior to disposal.

Existing processes, examples of which are discussed herein, deal primarily with managing the fresh caustic requirements of a refinery and thus focus in regenerating the effluent caustic by removing most of the sulfides and mercaptides. For instance, one method of regenerating the alkaline solution is air/steam stripping of the mercaptides from the alkaline solution. In yet another method, the sulfides and mercaptides are oxidized in the presence of oxygen in an oxidation zone to thiosulfate and disulfides. The thiosulfates remain dissolved in the alkaline solution and reduce the alkalinity of the alkaline hydroxide solution. The disulfides, which are relatively insoluble in the alkaline solution, may then be removed therefrom by contacting the alkaline solution with an organic solvent. In order to carry out the oxidation, a catalyst is generally employed. The catalyst includes certain metal chelates, for example, phthalocyanine disulfonate. The oxidation zone typically involves a column having suitable contacting means such as trays with bubble caps, suitable spacing material such as Raschig rings or a plurality of fibers positioned longitudinally in the column.

U.S. Pat. No. 2,921,021 to Urban et al. relates to the treatment of a sour hydrocarbon distillate with an alkaline solution. The effluent alkaline solution containing mercaptides is then mixed with air in a regenerator whereby the mercaptides are oxidized to disulfides. The regenerated caustic and disulfides are in the form of a finely dispersed mixture. The dispersion is passed through a coalescing system and then to a settling tank whereby the disulfide compounds are separated from the alkaline solution. While most of the disulfides are removed in the settling tank, in some cases the settling step may be followed by a naphtha wash to remove disulfides still retained in the alkaline solution.

U.S. Pat. No. 2,853,432 to Gleim et al. discloses the regeneration of used alkaline reagents by oxidizing same using a phthalocyanine catalyst. For example, mercaptides contained in a caustic solution were oxidized to disulfides, which were then withdrawn from the regeneration zone by skimming or by dissolving in a suitable solvent such as naphtha.

U.S. Pat. No. 3,574,093 to Strong relates to a multi-step process wherein the effluent caustic solution generated by treating a low-boiling hydrocarbon stream for mercaptan removal is thereafter used in a second treating step wherein a higher boiling sour distillate is sweetened. In the sweetening step, the mercaptans in the sour distillate are oxidized to disulfides. The disulfides exit the treating stage in the hydrocarbon stream along with those mercaptides which had been previously extracted and oxidized from the low boiling hydrocarbon stream. Thus, the higher boiling stream is sweetened at the same time. The regenerated caustic solution is then introduced into a separation zone from which the disulfide phase is recovered from the caustic zone. The coalescence of the disulfide compound into a separate phase is stated to be extremely difficult without the use of coalescing agents. In addition, a high residence time is used in the separation zone to further facilitate this phase separation.

U.S. Pat. No. 4,362,614 to Asdigian also relates to a multi-step process for the extraction of mercaptans from hydrocarbon streams with an alkaline solution, followed by the regeneration of the mercaptide-containing alkaline solution resulting from such extraction by oxidation in the presence of a catalyst in an oxidation zone, followed by the separation of the disulfides and the alkaline solution by decantation within a phase separation zone. From this process, the alkaline solution is recycled. In addition to the requirement of a separate oxidation zone and a large settling zone, the use of additional coalescing means is said to be required.

U.S. Pat. No. 4,666,689 to Maple et al. discloses regenerating a effluent alkaline solution by adding a suitable oxidation catalyst to the effluent alkaline solution and contacting the alkaline solution with an oxygen-containing solvent in a reaction zone, wherein the solvent is immiscible with the effluent alkaline solution. The reaction zone comprises a plurality of fibers positioned longitudinally within a conduit, whereby the two liquids, i.e., the effluent alkaline solution containing the oxidation catalyst and the oxygen-containing solvent, are in contact while co-currently flowing through the reaction zone during which the mercaptides are oxidized to disulfides and are simultaneously extracted from the alkaline solution to the solvent.

However, the aforementioned processes do not provide a satisfactory solution to the problem of disposal of the alkaline solution when after it has been used a number of times it is no longer suitable for any use in the refinery. Moreover, during a typical treatment of thermal or catalytic cracked hydrocarbon streams any phenolics contained therein are converted to phenolates, for instance cresylic acid is converted into sodium cresylate, which are subsequently incorporated into the alkaline stream. This has the undesired effect of reducing the volume of the hydrocarbon stream. Moreover, it requires special handling of the effluent alkaline solution for disposal purposes. Methods and associated equipment available to recover the cresylates are complex and very costly. Because the volume of the effluent alkaline solution generated by individual operators is relatively small, it is generally not economically feasible for these operators to regenerate such phenolate containing alkaline solutions. Some companies recover cresylates from effluent alkaline solutions which are transported to them, but, the additional transportation costs renders this option economically deficient or often times unfeasible.

Therefore, there is a need for a simple and inexpensive method for treating effluent alkaline solutions containing phenolates, sulfides and mercaptides to separate the aqueous alkaline solution for disposal or reuse.

SUMMARY OF THE INVENTION

The present invention is directed to a simple and inexpensive method and apparatus for treating alkaline streams containing sulfides, mercaptides, and phenolates, hereinafter also referred to as a spent or effluent alkaline solution. Accordingly, in the broad aspects of this invention, the sulfides, mercaptides and phenolates are released from the alkaline solution by contacting the solution with carbon dioxide under mass transfer conditions. The carbon dioxide decreases the pH of the effluent alkaline solution to a pH of about 7 or greater and reacts with the sulfides, mercaptides and phenolates to form hydrogen sulfide, mercaptans and phenolic compounds respectively, the majority of which, particularly the phenolics, can be returned to the hydrocarbon product stream. The bulk of the hydrogen sulfide, mercaptans and phenolic compounds are absorbed into the solvent. The treated alkaline solution is a benign waste and can be disposed of on-site in a biological wastewater treating plant, without any special handling. The carbon dioxide is preferably dissolved in a hydrocarbon solvent to accomplish its mass transfer contact. The preferable solvent is the hydrocarbon product which has been recovered from the caustic treatment so that the solvent can be returned to the product stream carrying the additional processable phenolics.

It is, therefore, an object of the present invention to provide an improved method of on-site treating of a refinery effluent alkaline stream such as caustic containing sulfides, mercaptides and phenolates, to render these effluents suitable for regular disposal without any special handling. Another object is to recover the phenols from the caustic stream to increase the processable hydrocarbon in the feed. Another object of the present invention is to provide a simple, economically feasible method for neutralizing the effluent caustic by reducing its alkalinity to a pH value of from about 7 to about 8 and removing contaminants from the aqueous stream.

An embodiment of the present invention provides an improved process for treating an aqueous alkaline stream containing sulfides, mercaptides and phenolates, wherein a solvent, preferably the hydrocarbon product of the process, containing carbon dioxide dissolved therein is introduced onto a plurality of fibers positioned longitudinally within a conduit or column, under favorable mass transfer or extraction conditions. The solvent flows concurrently through the conduit with the aqueous alkaline solution, immiscible with the solvent, resulting in at least a portion of the sulfides, mercaptides and phenolates being converted to hydrogen sulfide, mercaptides and phenolic compounds which are absorbed into the solvent.

It is yet another object of the present invention to provide a simple and inexpensive process and a compact and inexpensive apparatus that will allow refineries to sweeten sour hydrocarbon distillates using an alkaline solution and subsequently treat, on-site, the effluent alkaline solution with carbon dioxide to render it suitable for direct disposal into a plant's biological wastewater treatment facility.

The present invention, therefore, provides an efficient, and compact system for treating effluent alkaline solutions which could otherwise be rendered a hazardous waste. Among its many advantages, other than those mentioned above, entrainment of the alkaline solution in the solvent/sulfur-containing mixture is avoided since the method of contacting the effluent alkaline solution with the carbon dioxide required for treatment is not dispersive in nature. Yet another advantage of the present invention is that the content of sulfides, mercaptides and phenolates in the treated alkaline solution is substantially reduced with the reaction of he stronger acid, $CO_2$ producing a sodium carbonate solution. Another advantage is that since the treating solution is buffered out at a pH of 7 or 8, costly materials of construction are not required to prevent metal corrosion. Another advantage is the recovery of additional hydrocarbon for processing which had heretofore been discarded. For all of the above reasons, less equipment is required for the treatment process of this invention than with present methods, and the equipment which is utilized in the practice of the present invention is smaller in size and simpler to operate than that utilized in prior art processes. Therefore, equipment investment and costs of operation are substantially lower.

Other objects, features and advantages of the present invention will be apparent from the following description of the preferred embodiments, given for the purpose of disclosure, and taken in conjunction with the accompanying drawings.

DETAILED DESCRIPTION

The process of the instant invention makes use of well known mass transfer techniques, apparatus and conditions as disclosed in U.S. Pat. Nos. 3,997,829; 3,992,156; and 4,753,722; and reference may be made to such patents, which are hereby incorporated by reference, for a full description of the mass transfer apparatus and mass transfer conditions for extraction between immiscible fluids.

Figure 1:
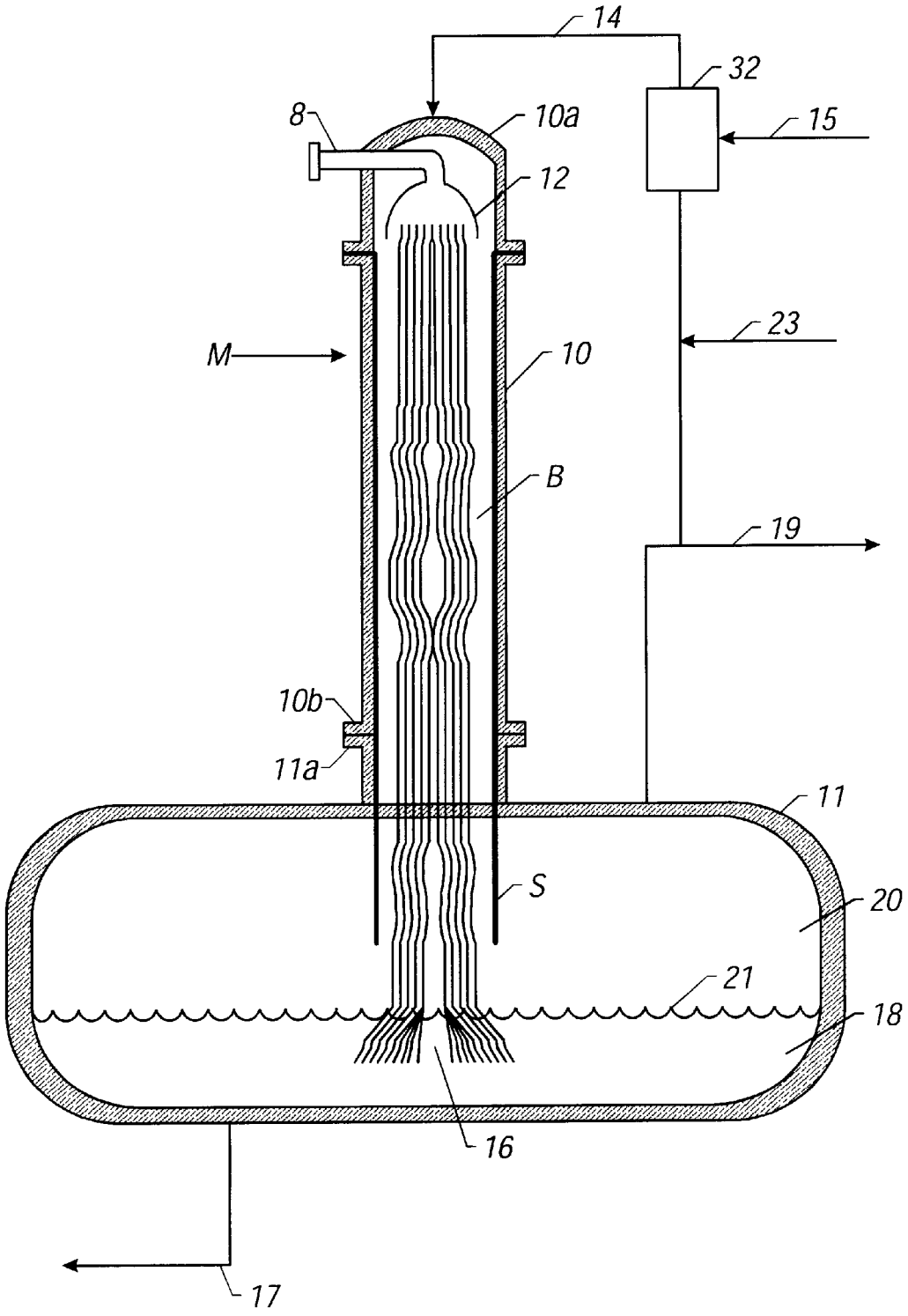
FIG. 1 is a schematic flow diagram of a process and apparatus for treating a effluent alkaline stream according to the present invention.

In the preferred embodiment of the present invention and with reference to FIG. 1, a mass transfer apparatus M includes a bundle B of substantially continuous elongated fibers mounted in a shroud S and contained within a conduit 10. The conduit 10 has an outlet flange 10*b* that is adapted for connection or placement with a mating flange 11*a* of collection vessel 11. A fluid distribution means 12 is mounted within an upper portion of conduit inlet assembly 10*a* for distributing the mercaptide-containing aqueous alkaline solution to be treated from the effluent alkaline solution feed line 8 onto the fibers within the bundle B. A second solution, line 14, is attached to the conduit inlet assembly 10*a* for delivering the carbon dioxide-containing solvent into the conduit inlet. The conduit outlet 10*b* is attached to mounting flange 11*a* of the collection vessel 11. Shroud S contains fiber bundle B which extends partly within the confines of the collection vessel 11. Other mechanical details of the mass transfer apparatus M are not necessary to an understanding of the invention and reference may be made to the aforementioned patents for further additional mechanical details. The positioning of the downstream end of the bundle B within the collection vessel 11 is such that it is within the treated alkaline solution which is collected as a lower layer in the collection vessel 11.

Collection vessel 11 contains a lower layer 18 of treated alkaline solution and an upper layer 20 of hydrocarbon solvent containing the hydrogen sulfide, mercaptans and phenolic compounds. Collection vessel 11 is preferably maintained at conditions which avoid the separation of gases from the liquids therein. The formation of gases within collection vessel 11 is avoided to prevent entrainment of the hydrocarbon solvent containing the hydrogen sulfide, mercaptans and phenolic compounds in the treated alkaline stream.

The fibers that comprise the bundle B are selected to meet two criteria. The fiber material must be preferentially wetted by the aqueous alkaline solution introduced by feed line 8 and the fibers must be of a material that will not contaminate the process or be destroyed by it, such as by corrosion. Accordingly, in as much as the present invention deals with aqueous alkaline solutions containing sulfur compounds, metallic fibers and, in particular, stainless steel or special corrosion resistant alloy fibers, are preferably employed.

Effluent alkaline streams which may be treated according to the present invention, include, for example, effluent aqueous potassium hydroxide solutions and effluent aqueous sodium hydroxide solutions, i.e., caustic. Such alkaline solutions are widely used for treatment of a variety of mercaptan-containing hydrocarbon streams, including liquid petroleum gas (LPG), butanes, butenes, gasoline streams, jet fuels, naphthas and the like. These effluent alkaline solutions resulting from the treatment of the aforementioned hydrocarbon streams can typically contain a number of different sulfur compounds, including, for example, such as the alkali metal mercaptides of corresponding mercaptans as methyl mercaptan, ethyl mercaptan, n-propyl mercaptan, iso-propyl mercaptan, n-butyl mercaptan, thiophenol and other branched and/or higher molecular weight mercaptans. Alkali metal sulfides can also be present in such effluent alkaline solutions due to the presence of hydrogen sulfide in the hydrocarbon streams which were previously treated with the alkaline solution. The presence of such sulfides does not adversely affect the efficiency of the present invention.

In order to treat sulfide, mercaptide, phenolate-containing alkaline streams according to the present invention, the effluent alkaline stream is flowed through line 8 into the inlet 10*a* and to the fluid distribution means 12 and onto the upstream end of the distribution means 12 and onto the upstream end of the fiber bundle B as illustrated in FIG. 1. Simultaneously, a suitable hydrocarbon solvent containing dissolved carbon dioxide is flowed through line 14, into the conduit inlet 10*a*, and then concurrently with and in intimate contact with the alkaline stream, passing over the fibers of the fiber bundle B contained within conduit 10, and then into the collection vessel 11. During the time the two immiscible fluids are in contact within conduit 10, the bulk of the sulfides, mercaptides and phenolates contained in the effluent alkaline solution are reduced with the carbon dioxide to hydrogen sulfide, mercaptans and phenolics and extracted into the hydrocarbon solvent and are thus removed from the alkaline solution.

As previously mentioned, the fiber material must be preferentially wetted by the aqueous alkaline solution introduced by feed line 8. If, however, the volumetric flow ratio of the hydrocarbon solvent to alkaline solution is less than about 1:1, phase inversion may occur resulting in the fiber material being preferentially wetted by the hydrocarbon solvent. It is preferred, therefore, that the volumetric flow ratio of the hydrocarbon solvent to alkaline solution be at least about 1:1, more preferably from about 2:1 to about 20:1, still more preferably about 3:1 to about 7:1, most preferably about 5:1.

The operating temperature ranges from about 60° F. to about 150° F. The preferred operating temperature ranges from about 100° F. to about 120° F.

Sufficient time must be allowed for the carbon dioxide to be transferred to the alkaline stream and for the sulfur-containing compound to be transferred back into the hydrocarbon stream. Because of the efficiency of the mass transfer apparatus, residence time in the fiber bundle may be rather short, from about thirty seconds to about three minutes. Preferred residence times are from about one to about two minutes.

The required amount of carbon dioxide concentration will vary depending in part on the level of sulfides, mercaptides and phenolates in the alkaline stream, as will be understood by those skilled in the art. At least a stoichiometric amount of carbon dioxide to react with the content of sulfides, mercapitides and phenolates should be present with an excess amount preferable, usually from about 1.1 to 3.0 times the stochiometric amount. Typically, the amount of carbon dioxide may range from about 10 to about 20,000 ppm by weight of the hydrocarbon solvent. The amount of carbon dioxide employed affects the pH of the system. The pH has a large impact on the effectiveness of the reduction and removal of sulfides, mercaptides and phenolates from the effluent alkaline stream. If the pH remains too high, the phenol cannot be extracted from the effluent alkaline solution. The pH is preferably at least about 7, more preferably from about 8 to about 11 and most preferably from about 9 to about 10. An automatic pH control system may be used to control carbon dioxide concentration based on the pH of the system.

The $CO_2$ reduction of alkali metal compounds contained in the effluent alkaline solution at a pH of 7 or above are summarized as follows:

Caustic: $2NaOH+CO_2 \rightarrow Na_2CO_3+H_2O$

Carbonate: $Na_2CO_3+CO_2+H_2O \rightarrow 2Na\ HCO_3$

Sodium Sulfide: $Na_2S+CO_2+H_2O \rightarrow Na_2CO_3+H_2S$

Sodium Mercaptide: $2NaSR+CO_2+H_2O \rightarrow Na_2CO_3+2RSH$

Sodium Cresylate: $2RONa+CO_2+H_2O \rightarrow Na_2CO_3+2ROH$

The carbon dioxide required for the release of the bulk of the hydrogen sulfide, mercaptans and phenolic compounds is introduced into the system through line 15 by dissolving carbon dioxide in the hydrocarbon solvent stream 14 via a sparger 32 that distributes $CO_2$ into very small bubbles into the hydrocarbon solvent. In the fiber bundle B, the carbon dioxide is transferred from the hydrocarbon stream into the alkaline solution. Carbon dioxide thus is available for chemical reaction with the sulfides, mercaptides and phenolates contained in the effluent alkaline stream as the respective fluids move through the mass transfer apparatus M. The amount of carbon dioxide provided is at least equal to the stoichiometric amount and generally is provided in excess of the stoichiometric amount.

The pressure in the system is maintained at a level such that the desired amount of carbon dioxide can be dissolved into the hydrocarbon stream without exceeding the solubility limits for carbon dioxide in the hydrocarbon. The higher the sulfide, mercaptide and phenolate concentration of the effluent alkaline solution to be treated, the more carbon dioxide must be dissolved in the hydrocarbon and higher system back pressure must be maintained in order to keep such amounts of carbon dioxide in solution. Typical system back pressures may range from about 25 psig to about 200 psig, preferably from about 30 psig to about 200 psig, with system back pressures of from about 50 psig to about 100 psig typically being sufficient for most normal sulfide, mercaptide and phenolate loadings. Below about 30 psig, the solubility of the carbon dioxide in the solvent is significantly reduced.

Any suitable organic solvent which is immiscible with the aqueous alkaline stream and does not otherwise adversely affect the overall process may be utilized. For example, many of the hydrocarbon streams described above as being treatable for mercaptan removal with alkaline streams may be employed as the solvent. Use of the hydrocarbon which has been treated by the alkaline stream such as aromatics, gasoline, hexane, kerosene, naphtha or mixtures of any such organic solvents will minimize the piping required to make solvent available in the process. The preferred solvent to use would be a product from the caustic treatment of naphtha or distillate hydrocarbon.

The streams flow concurrently in a mass transfer relationship through the shroud S for a time sufficient for the reduction reaction between the carbon dioxide and the sulfides, mercaptides and phenolates to take place. This residence time is normally from about 30 seconds to about 3 minutes. Of course greater time can be used without affecting the results of the invention.

The downstream end of shroud S containing the fiber bundle B extends into the collection vessel 11 sufficiently so as to allow the end 16 of the fiber bundle to contact the treated alkaline stream layer 18. Thus, as the alkaline and solvent streams flow from the conduit 10 into the collection vessel 11, the treated alkaline stream, being immiscible with the solvent, separates and collects as a bottom layer 18 and the hydrocarbon solvent, now containing bulk of the $H_2S$, mercaptans and/or phenolic compounds previously present in the effluent alkaline solution, accumulates as an upper layer 20 in the collection vessel 11. The interface 21 between the solvent and treated alkaline solution may vary, but it is preferred that the interface remain above the lower or downstream end of the fiber bundle B as illustrated in FIG. 1. The collection vessel 11 is preferably sized and the interface 21 maintained at such a level that a residence time of at least fifteen minutes is achieved for the aqueous phase in the collection vessel 11. As a result of the simultaneous release and extraction of the bulk of the hydrogen sulfide, mercaptans and/or phenolic compounds previously present in the effluent alkaline solution into the solvent within the fiber bundle B, a treated alkaline stream 17 of reduced sulfide, mercaptide and phenolate content is produced.

The solvent and the treated alkaline streams are withdrawn separately from the collection vessel 11. The treated alkaline stream 17 containing traces of impurities and sodium carbonate may be disposed of or treated in a biological or chemical oxidation system to oxidize the trace levels of sulfur and phenolic impurities remaining in the alkaline solution.

The hydrocarbon solvent containing the bulk of the hydrogen sulfide, mercaptans and/or phenolic compounds previously present in the effluent alkaline solution may be processed further to recover same therefrom, may be blended into the product pool, or may be recycled to the inlet line 14 for further use in the process of the present invention. Also, since the solvent loses its effectiveness as its level of sulfur compounds increase, it may be desirable to remove some of the sulfur compound-containing solvent such as through line 19 and to add fresh, lean solvent such as through line 23 from time to time or in a continuous mode, in order to maintain the proper efficiency of extraction of sulfur compounds. The phenols and hydrocarbon solvent can be returned to the product stream in a form for further processing.

It has been found that the present method of treating alkaline streams is quite superior to conventional processes employing separate zones to effect the neutralization and separation steps inherent in the overall treating process. Moreover, the use of a suitable fiber bundle contacting device in the present invention provides for a compact process and results in reduced capital costs.

It will be understood by those skilled in the art that the efficiency of the overall treatment process of the present invention will depend upon a number of parameters, including the rates of mass transfer of carbon dioxide into the alkaline stream to provide the carbon dioxide for the reduction of the sulfides, mercaptides and phenolates to hydrogen sulfide, mercaptans and phenols respectively and the extraction thereof from the alkaline stream into the solvent. Such parameters as the surface area of the fiber bundle B, the rate of flow of streams entering the lines 8 and 14, the amounts of carbon dioxide in either of the reactant streams, residence time of the respective materials within the mass transfer apparatus M, and temperature and pressure conditions may be varied depending on the chemical composition of sulfur compounds contained in the alkaline stream to be treated, the type of hydrocarbon solvent used, and other factors as will be appreciated by those skilled in the art.

Figure 2:
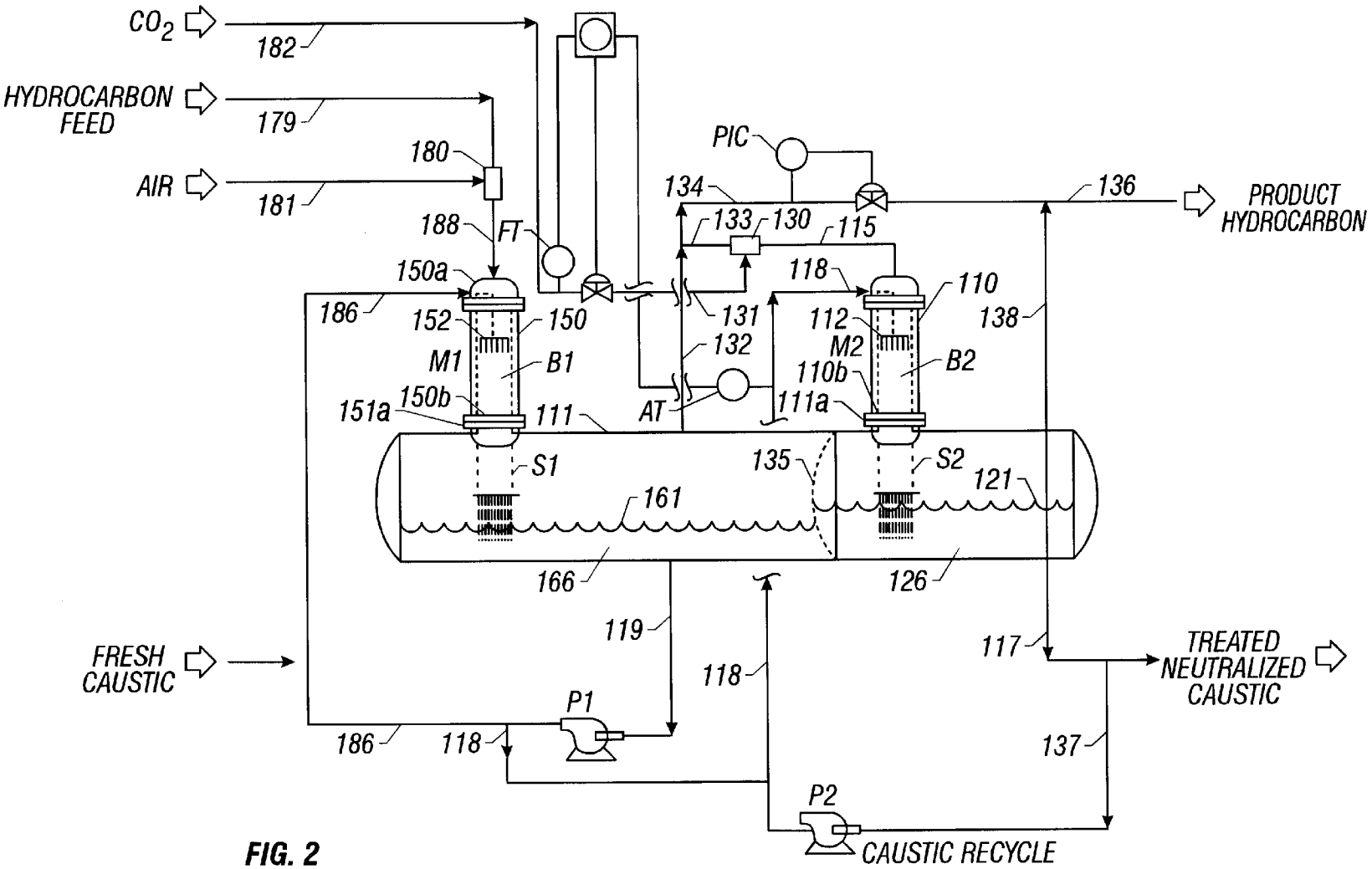
FIG. 2 is a schematic flow diagram of a process and apparatus for treating a hydrocarbon having sulfur compounds with an alkaline solution and then treating the effluent alkaline solution with carbon dioxide.

Referring now to FIG. 2, a second embodiment of the present invention is shown, whereby a sour hydrocarbon distillate 179 containing mercaptan compounds to be oxidized are contacted with an aqueous alkali metal hydroxide solution 186, an oxidizing agent 181 and a soluble metal phthalocyanine catalyst in a mass transfer apparatus M1, while in contact with a bundle of elongated fibers B1 contained in a conduit 150. The mass transfer apparatus M1 is almost identical to the mass transfer apparatus M of FIG. 1. The fiber bundle B1 is mounted in a shroud S1 contained in conduit 150.

These fibers B1 are fed through distributing means 152 with aqueous alkali metal hydroxide from tube 186. The hydrocarbon distillate to be treated enters through line 188 fed by charge stock from line 179 which is mixed with oxygen, preferably in the form of air, through sparger 180 from intake line 181. Further mechanical and operational details of the oxidization zone of the apparatus of FIG. 2 can be found in U.S. Pat. No. 4,675,100 assigned to Merichem Company, and which is incorporated herein by reference for all purposes. Conduit 150 has an outlet flange **150*b* that is adapted for connection or placement with a mating flange 151***a* of collection vessel 111.

Vessel 111 is a separator having two separation zones 126 and 166, which are separated from each other by an internal wall 135. Mass transfer apparatus M1 is in fluid communication with the separation zone 166 of vessel 111 through the flange connection 150*b* and 151*a*. The downstream end of the fibers B1 extends into the separation zone 166 and is within the effluent alkaline solution which is collected as a lower layer in the collection vessel 111. In operation, the fibers B1 are wetted by the aqueous caustic solution in preference to the hydrocarbon mixture. The aqueous caustic solution forms a film on the fibers B1 which is dragged downstream through the conduit 150 by the passage of the hydrocarbon distillate through the same conduit. Both liquids are discharged into the separation zone 166 of the separator 111. While in contact with the fibers B1, acidic impurities commonly found in a hydrocarbon charge stock, for example, such as hydrogen sulfide, mercaptans, phenolics and other organic acids, are removed by extraction and/or oxidation from the hydrocarbon distillate.

In the separation zone 166, the aqueous caustic solution is collected in the lower layer as it is heavier than, and immiscible in, the hydrocarbon. The interface 161 within separation zone 166 is normally kept at a level above the bottom of the downsteam end of the fibers B1 so that the aqueous caustic film can be collected directly in the bottom of the separator zone 166 without it being dispersed into the hydrocarbon. Thus separated, the hydrocarbon no longer contains hydrogen sulfide and mercaptans, but may still contain large quantities of phenolic impurities.

The conduit 150 and the fiber bundle B1 enclosed therein are designed, and sized, to have a length and diameter such that the speed at which the liquids proceed from one end to the other end of the bundle B1 is preferably from about 2 to about 20 centimeters per second, for example, about 10 centimeters per second, and the residence time preferably ranges from about 30 seconds to about 5 minutes, for example about one minute residence time for contact.

The aqueous caustic containing mercaptides, sulfides and phenolates, referred to also as effluent caustic or effluent alkaline solution, separates from the treated hydrocarbon in the separation zone 166 with the aqueous caustic collecting at the bottom of the vessel with the treated hydrocarbon at the top of the separation zone 166.

The effluent caustic is then transferred to a second mass transfer apparatus M2, whereby the sulfides, mercaptides and phenolates contained in the effluent alkaline solution are released therefrom and chemically reduced to hydrogen sulfide, mercaptans and phenols, respectively, by contacting same with an immiscible solvent containing carbon dioxide. The effluent caustic to be treated enters the mass transfer apparatus M2 through line 118 fed by caustic from separation zone 166 through line 119. The carbon dioxide-containing hydrocarbon enters the mass transfer apparatus M2 through line 115 fed by carbon dioxide from line 182 via line 131 and which is mixed with a portion of the treated hydrocarbon from the separation zone 166 through sparger 130 which distributes very small bubbles of carbon dioxide into the hydrocarbon stream from lines 132 and 133. The pH of the recycle caustic in line 118 is measured by a pH analyzer. This pH is used to control the flow rate of carbon dioxide in line 131 to sparger 130. As earlier noted, the pH has a large impact on the effectiveness of the reduction and removal of sulfides, mercaptides and phenolates from the effluent alkaline stream. If the pH stays too high, the phenol extraction from the effluent alkaline solution becomes difficult. The pH is preferably at least 7, more preferably from about 8 to about 11, and most preferably from about 9 to about 10. The automatic pH control system preferably used here to control carbon dioxide concentration is based on the pH of the recycled alkaline stream 118, together with its flow rate. This provides better anticipation for the control of the pH within the mass transfer apparatus M2. The remainder of the treated hydrocarbon from separation zone 166 is directed through line 134 to the product hydrocarbon line 136. The mass transfer apparatus M2 is mounted on vessel 111 through flanges 110*b* and 111*a*, and is in fluid communication with the second separation zone 126. The effluent alkaline solution is treated in apparatus M2 according to the process of FIG. 1, which is described above. Neutralized caustic also referred to as treated caustic or treated alkaline solution, and hydrocarbon enter the separation zone 126 where the aqueous neutralized caustic will collect in the lower portion. As described previously, the interface 121 is kept at a level above the bottom of the downstream end of the fibers B2. Separated hydrocarbon is passed through line 138 to the product hydrocarbon line 136. The treated caustic stream 117 may, for instance, be disposed of treated in a biological or chemical oxidation system.

In the preferred embodiment of FIG. 2, the diameter of separation zone 126 is the same as that of zone 166. This allows the use of a single vessel having two compartments as the separator 111 is separated by a partition 135. The length of separation zone 126 is designed so as to allow a preferred residence time of from about 15 minutes to about 20 minutes in the hydrocarbon phase of the separation zone while having enough volume to hold the caustic volume of separation zone 166. The overall length to diameter (L/D) ratio of separator 111 is maintained in a range of from about 10:1 to about 2:1; preferably from about 5:1 to about 2:1. The separation zone 126 may have a lower residence time, but it is preferred not to be less than 15 minutes in order to meet the preferred L/D.

The present invention, therefore, is well adapted to carry out the objects and attain the end and advantages mentioned, as well as those inherent herein. While presently preferred embodiments of the invention have been given for the purpose of disclosure, numerous changes in the details of construction, arrangements of parts and operation of the process can be made which will readily suggest themselves to those skilled in the art and which are encompassed within the spirit of the invention and the scope of the appended claims.

What is claimed:

1. A process for treating an effluent aqueous stream of alkali metal hydroxide containing at least one alkali metal sulfide, mercaptide or phenolate to neutralize the effluent aqueous stream, and recover useful products comprising the steps of:

introducing the effluent aqueous stream of alkali metal hydroxide containing at least one alkali metal compound onto an upstream end of a plurality of fibers positioned longitudinally within a conduit, a downstream end of the fibers extending out of the conduit making contact with a treated alkali metal hydroxide liquid layer in a collection vessel;

flowing a liquid stream of hydrocarbon solvent having at least a stoichiometric amount of carbon dioxide dissolved therein to react with the alkali metal compounds concurrently through the conduit, with and in contact with the effluent aqueous stream of alkali metal hydroxide, at a flow rate, temperature and pressure, whereby at least a portion of at least one alkali metal compound in the alkaline stream is reduced;

receiving the hydrocarbon solvent and the alkali metal hydroxide streams in the collection vessel wherein the alkali metal hydroxide stream of reduced sulfide, mercaptide and phenolate content forms the treated alkali metal hydroxide liquid layer in the lower portion of the collection vessel and the hydrocarbon solvent containing extracted mercaptans and phenols forms an upper layer in the collection vessel;

withdrawing the hydrocarbon solvent containing the extracted reduced compounds from the upper portion of the collection vessel; and withdrawing the treated aqueous stream of alkali metal hydroxide from the lower portion of the collection vessel.

2. The process of claim 1, wherein the hydrocarbon solvent used for dissolving the carbon dioxide is a portion of the hydrocarbon product from which the hydrogen sulfide, mercaptans and phenolics were removed.

3. The process of claim 2, wherein the hydrocarbon solvent containing extracted sulfur and phenolic compounds is thereafter returned to the hydrocarbon product stream.

4. The process of claim 1, wherein the alkali metal hydroxide is sodium hydroxide.

5. The process of claim 1, wherein the hydrocarbon solvent boils in the gasoline range or above.

6. The process of claim 1, wherein the hydrocarbon solvent is selected from the group consisting of gasoline, naphtha, kerosene, hexane and mixtures thereof.

7. The process of claim 1, wherein the temperature of the aqueous stream is about 150° F.

8. The process of claim 1, wherein the pressure of the aqueous stream is from about 25 psig to about 150 psig.

9. The process of claim 1, wherein the flow rates of the effluent aqueous stream of alkali metal hydroxide and the stream of hydrocarbon solvent are such that contact time is from about thirty seconds to about three minutes.

10. A process for treating an aqueous stream of alkali metal hydroxide containing sulfide, mercaptide and phenolate compounds by the simultaneous reduction of sulfide to hydrogen sulfide, mercaptide to mercaptans, and phenolate to phenolic compounds and extraction of the hydrogen sulfide, mercaptans and phenolic compounds formed from the aqueous stream, the process comprising:

introducing an aqueous stream of alkali metal hydroxide containing sulfide, mercaptide and phenolate compounds onto an upstream end of a plurality of fibers positioned longitudinally within a conduit, a downstream end of the fibers extending out of the conduit making contact with a treated alkali metal hydroxide aqueous liquid layer in a collection vessel;

contacting the stream of alkali metal hydroxide, in concurrent flow through the conduit with a liquid stream of hydrocarbon solvent having at least a stoichiometric amount of carbon dioxide dissolved therein to react with the alkali metal compounds at a volumetric flow ratio of the hydrocarbon solvent to the alkali metal hydroxide of at least about 1:1, and at a pH, temperature and pressure, whereby at least a portion of the sulfide, mercaptide and phenolate compounds in the alkaline stream are reduced;

extracting at least a portion of the hydrogen sulfide, mercaptans and phenolic compounds formed into the hydrocarbon solvent from the aqueous stream of alkali metal hydroxide simultaneously with the reduction of the sulfide, mercaptide and phenolate compounds in the conduit;

receiving the hydrocarbon solvent and the alkali metal hydroxide streams in a collection vessel wherein the alkali metal hydroxide and carbonate stream of reduced sulfide, mercaptide and phenolate content forms a lower layer in the collection vessel and the hydrocarbon solvent containing the extracted hydrogen sulfide, mercaptans and phenolic compounds form an upper layer in said collection vessel;

withdrawing the hydrocarbon solvent containing the extracted hydrogen sulfide, mercaptans and phenolic compounds from the collection vessel; and withdrawing the alkali metal hydroxide of reduced sulfide, mercaptide and phenolate content from the collection vessel.

11. The process of claim 10, wherein the volumetric flow ratio of hydrocarbon solvent to alkali metal hydroxide solution is from about 2:1 to about 20:1.

12. The process of claim 11, wherein the volumetric flow ratio of hydrocarbon solvent to alkali metal hydroxide solution is from about 3:1 to about 7:1.

13. The process of claim 12, wherein the volumetric flow ratio of hydrocarbon solvent to alkali metal hydroxide solution is about 5:1.

14. A process for oxidizing mercaptan compounds contained in a sour hydrocarbon distillate, the process comprising the steps of:

introducing the sour hydrocarbon distillate onto an upstream end of a plurality of fibers positioned longitudinally within a conduit, a downstream end of the fibers extending out of the conduit making contact with an alkali metal hydroxide liquid layer in a first separation zone;

flowing a first aqueous stream of alkali metal hydroxide through the conduit, with and in contact with the hydrocarbon, at the flow rate, temperature and pressure sufficient to oxidize at least a portion of said mercaptan compounds and forming an effluent aqueous alkali metal hydroxide solution containing at least one alkali metal compound and a treated hydrocarbon distillate;

separating the effluent aqueous alkali metal hydroxide solution from the treated hydrocarbon distillate in the first separation zone;

introducing the effluent aqueous stream of alkali metal hydroxide containing at least one alkali metal compound onto an upstream end of a plurality of fibers positioned longitudinally within a second conduit, a downstream end of the fibers extending out of the conduit making contact with a treated alkali metal hydroxide liquid layer in a second separation zone;

flowing a liquid stream of hydrocarbon solvent having at least the stoichiometric amount of carbon dioxide dissolved therein to react with the alkali metal compounds concurrently through the conduit, with and in contact with the effluent aqueous stream of alkali metal hydroxide, at a flow rate, temperature and pressure, whereby at least a portion of the at least one alkali metal compound in the alkaline stream is reduced to the reduced compound;

simultaneously with reduction of the at least one alkali metal compound in the conduit extracting at least a portion of the reduced compound formed into the hydrocarbon solvent from the effluent aqueous stream of alkali metal hydroxide;

receiving the hydrocarbon solvent and the alkali metal hydroxide streams in the second separation zone wherein the alkali metal hydroxide stream of reduced sulfide, mercaptide and phenolate content forms a layer of a treated alkali metal hydroxide liquid in the lower portion of the second separation zone and the hydrocarbon solvent containing the extracted reduced compound forms a layer in the upper portion of the second separation zone;

withdrawing the hydrocarbon solvent containing the extracted reduced compound from the upper portion of the collection vessel; and withdrawing a treated aqueous stream of alkali metal hydroxide from the lower portion of the collection vessel for disposal or further treatment.

15. The process of claim 14, wherein the reduced compound is selected from the group consisting of hydrogen sulfide, mercaptans and phenols.

16. A process for treating an effluent aqueous stream of alkali metal hydroxide containing at least one alkali metal sulfide, mercaptide or phenolate to neutralize the effluent aqueous stream, and recover useful products comprising the steps of:

contacting, under mass transfer conditions, the effluent aqueous stream, in concurrent flow, with at least a stoichiometric amount of carbon dioxide, based upon the sulfide, mercaptide and phenolate content of the stream, dissolved in a hydrocarbon solvent, for a time sufficient for the carbon dioxide to react with the alkali metal sulfide, mercaptide and phenolate to form reaction products soluble in the solvent and to neutralize the alkaline stream;

discharging the aqueous stream and hydrocarbon to a separation zone wherein the hydrocarbon aqueous stream separates into a hydrocarbon phase and an aqueous phase;

recovering the hydrocarbon phase containing phenolic compounds in a form which can be further processed.

17. A process for removing hydrocarbon acidic compounds contained in sour gasoline and recovering the hydrocarbon into the gasoline for subsequent processing, comprising the steps of:

introducing the sour gasoline with a sufficient dissolved oxygen onto an upstream end of a plurality of fibers positioned longitudinally within a conduit, a downstream end of the fibers extending out of the conduit making contact with a sodium hydroxide aqueous liquid layer in a first separation zone;

flowing a first aqueous stream of sodium hydroxide through the conduit in contact with the gasoline and oxygen at a flow rate, temperature and pressure sufficient to react with at least a portion of said acidic hydrocarbon compounds and forming an effluent aqueous sodium hydroxide solution containing reacted acidic compounds and a treated gasoline;

separating the effluent aqueous sodium hydroxide solution from the treated gasoline in the first separation zone;

introducing the effluent aqueous stream sodium hydroxide onto an upstream end of a plurality of fibers positioned longitudinally within a second conduit, a downstream end of the fibers extending out of the conduit making contact with an aqueous liquid layer in a second separation zone;

flowing at least a portion of the treated gasoline from the first separation zone, as a solvent, having at least a stoichiometric amount of carbon dioxide dissolved therein to react with reacted acidic compounds in the effluent aqueous stream concurrently through the conduit in contact with the effluent aqueous stream of sodium hydroxide, at a flow rate, temperature and pressure, whereby at least a portion of the reacted acidic compounds in the aqueous stream is reduced to a hydrocarbon soluble in the treated gasoline;

simultaneously with reduction of the oxidized sulfur metal compound in the conduit extracting at least a portion of the hydrocarbon into the treated gasoline solvent;

receiving a gasoline solvent and the aqueous sodium hydroxide streams in the second separation zone wherein the sodium hydroxide stream and the gasoline solvent containing the extracted hydrocarbon are separated;

recovering the treated gasoline solvent containing the extracted hydrocarbon from the second separation zone; and withdrawing a treated aqueous stream of sodium hydroxide from the second separation zone for recycle, disposal or further treatment.

* * * * *